US008757476B2

(12) United States Patent
Childress

(10) Patent No.: US 8,757,476 B2
(45) Date of Patent: Jun. 24, 2014

(54) RECEPTACLE REPAIR INSERT

(76) Inventor: Douglas Todd Childress, Windermere, FL (US)

( * ) Notice: Subject to any disclaimer, the term of this patent is extended or adjusted under 35 U.S.C. 154(b) by 0 days.

(21) Appl. No.: 13/108,178

(22) Filed: May 16, 2011

(65) Prior Publication Data

US 2011/0308042 A1 Dec. 22, 2011

Related U.S. Application Data

(60) Provisional application No. 61/357,013, filed on Jun. 21, 2010.

(51) Int. Cl.
*A47G 29/12* (2006.01)

(52) U.S. Cl.
USPC ..... 232/29; 232/17; 232/38; 29/402.08; 29/447

(58) Field of Classification Search
USPC ..... 232/29, 17, 45, 38, 33; 220/23.87, 220/23.89, 810, 827; 403/273; 29/402.03, 29/447; 264/342
See application file for complete search history.

(56) References Cited

U.S. PATENT DOCUMENTS 4,181,250 A * 1/1980 Withrow ..... 232/44
4,333,603 A * 6/1982 Carlson ..... 232/17
4,932,587 A * 6/1990 Robbins ..... 232/17
5,915,618 A * 6/1999 Gaudet ..... 232/33
5,988,495 A * 11/1999 Lackey et al. ..... 232/17
6,123,257 A * 9/2000 Guidicy ..... 232/17
6,234,387 B1 * 5/2001 Cuthbert et al. ..... 232/29
6,808,108 B1 * 10/2004 Turnbow et al. ..... 232/29
6,923,367 B1 * 8/2005 Grossman et al. ..... 232/17
6,997,373 B2 * 2/2006 Flores ..... 232/29
7,070,090 B2 * 7/2006 Ranen ..... 232/45
7,178,717 B1 * 2/2007 Lindell ..... 232/45
7,182,244 B2 * 2/2007 Brown ..... 232/38
7,931,189 B2 * 4/2011 Kalenburg ..... 232/45
8,261,965 B2 * 9/2012 Cyphers et al. ..... 232/45
2004/0238615 A1 * 12/2004 Offenbacher ..... 232/29

* cited by examiner

*Primary Examiner* — William Miller
(74) *Attorney, Agent, or Firm* — Timothy H. Van Dyke; Beusse, Wolter, Sanks, Mora & Maier, P.A.

(57) ABSTRACT

Herein disclosed is a receptacle repair insert, which may have an insert body with at least an outer surface. The outer surface may have a first shape and be effective to attach to a receptacle body having at least an inner surface with a second shape. The inner surface may define at least one orifice and the insert body may be effective to fit into the at least one orifice. The receptacle repair insert may also have at least one extension movably connected to the insert body wherein the extension is effective to create a door. The extension may block at least a portion of the at least one orifice. Further disclosed is a method for replacing at least one mailbox door using at least one embodiment of the receptacle repair insert.

10 Claims, 3 Drawing Sheets

RECEPTACLE REPAIR INSERT

CROSS-REFERENCE TO RELATED APPLICATIONS

This application claims the benefit under 35 U.S.C. 120 to provisional application No. 61/357,013 filed on Jun. 21, 2010, which is herein incorporated by reference in its entirety.

STATEMENT REGARDING FEDERALLY SPONSORED

Not federally sponsored.

FIELD

At least some embodiments relate to orifice extensions, more specifically to insertable and removable extensions for orifices.

SUMMARY

Herein disclosed is a receptacle repair insert, which may have an insert body with at least an outer surface. The outer surface may have a first shape and be effective to attach to a receptacle body having at least an inner surface with a second shape. The inner surface may define at least one orifice and the insert body may be effective to fit into the at least one orifice. The receptacle repair insert may also have at least one extension movably connected to the insert body wherein the extension is effective to create a door. The door may block at least a portion of the at least one orifice.

Further disclosed is a method for replacing at least one mailbox door, which may have the steps of providing at least one mailbox repair insert, removing at least one undesired mailbox door if one exists, and placing the at least one mailbox repair insert into the at least one mailbox, the steps not in any particular order. The mailbox repair insert may have an insert body having an outer surface, the outer surface having a shape effective to fit an inner surface of at least one mailbox. The mailbox repair insert may also have at least one mailbox door rotatably connected to the insert body, the door being effective to open and close access to the at least one mailbox.

BRIEF DESCRIPTION OF THE DRAWING

Some embodiments are better understood by reading the following Detailed Description, taken together with the Drawings, wherein.

DETAILED DESCRIPTION

Figure 1A:
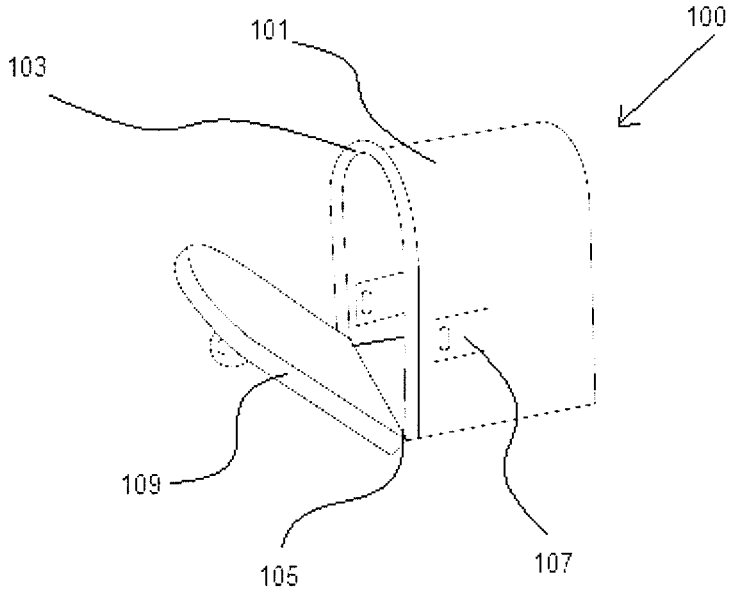
FIG. 1A is a perspective view of an embodiment of a receptacle repair insert in accordance with the present Disclosure.

Disclosed embodiments in this Disclosure are described with reference to the attached figures, wherein like reference numerals are used throughout the figures to designate similar or equivalent elements. The figures are not drawn to scale and they are provided merely to illustrate the disclosed embodiments. Several aspects are described below with reference to example applications for illustration. It should be understood that numerous specific details, relationships, and methods are set forth to provide a full understanding of the disclosed embodiments. One having ordinary skill in the relevant art, however, will readily recognize that the subject matter disclosed herein can be practiced without one or more of the specific details or with other methods. In other instances, well-known structures or operations are not shown in detail to avoid obscuring structures or operations that are not well-known. This Disclosure is not limited by the illustrated ordering of acts or events, as some acts may occur in different orders and/or concurrently with other acts or events. Furthermore, not all illustrated acts or events are required to implement a methodology in accordance with this Disclosure.

Notwithstanding that the numerical ranges and parameters setting forth the broad scope of this Disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

Referring to FIG. 1A, 1B, 1C, and 1D, at least one non-limiting embodiment of a receptacle repair insert 100 is shown. In accordance with at least some embodiments, a receptacle repair insert 100 may have an insert body 101 having an outer surface.

The outer surface may have a first shape. The first shape may be anything that allows the insert body 101 to fit into at least one receptacle body with an inner surface having a second shape defining at least one orifice 102. For example, the first shape may be approximately shaped to fit inside the second shape in a manner that the outer surface abuts and follows said inner surface.

The at least one receptacle body may be a mailbox, and the second shape may be such that it defines a standard mailbox orifice. The first shape and the second shape may be the about the same or different, allowing the insert body 101 to fit into the orifice.

Figure 1B:
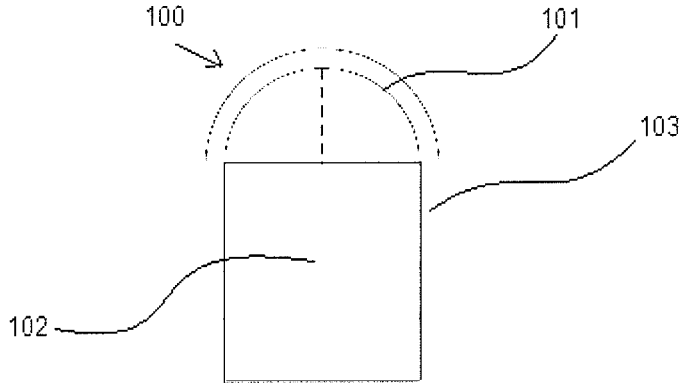
FIG. 1B is a front view of an embodiment of a receptacle repair insert in accordance with the present Disclosure.
Figure 1C:
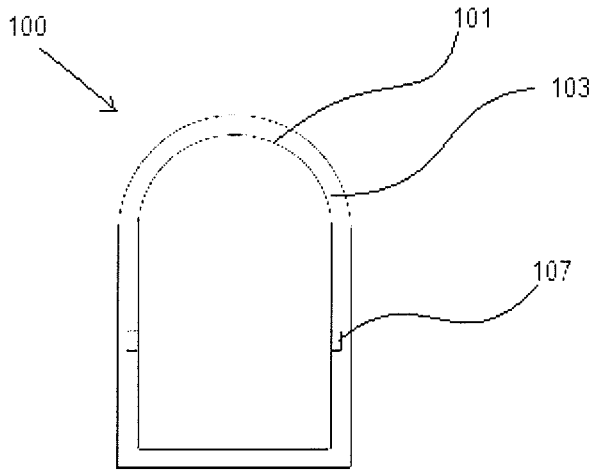
FIG. 1C is a rear view of an embodiment of a receptacle repair insert in accordance with the present Disclosure.

At least a portion of the insert body 101 may have at least one flange 103. The at least one flange 103 may take any size, shape and thickness. The flange 103 may follow a terminus of the insert body 101 such as the front end of the insert body 101. The flange 103 may be effective to abut a receptacle. terminus to stop the insert body 101 from entering any further into a receptacle. The outer surface and/or inner surface of the insert body 101 may include a first portion and a second portion. The first portion may include a curved shape and the second portion may be flat, such that the sides of the first portion contact the sides of the flat second portion to define an opening therebetween, in one embodiment, as shown in FIGS. 1A-1C. The flange 103 may circumscribe the first portion of the front end of the insert body 101 as provided in FIG. 1A and FIG. 2. The flange 103, therefore, may circumscribe the first portion of the insert body 101 at the front end of the insert body 101 such that it extends to and terminates at the second portion of the insert body 101, in one embodiment.

The insert body 101 may be effective to attach to an inner surface of a receptacle body 100. The insert body 101 may be attached to the inner surface using an attachment method effective to connect said insert body 101 with said receptacle body.

The attachment method may be a material expansion created by shrink-fitting said insert body to said inner surface of said receptacle body. In some embodiments, the attachment method is at least one of a clamp, hook, latch, extension, protrusion, cut-out, friction, seal, adhesive, or anything that is effective to apply a force to the inner surface.

In at least some embodiments where the attachment is mechanical in nature, the attachment may be spring loaded. The spring loading may be applied in any manner sufficient such as using a conventional spring or other material resistance due to deformation.

In some embodiments, the attachment is at least one protrusion 107 of the insert body 101 effective to communicate with at least one contour of said inner surface of said receptacle body. The at least one protrusion 107 may be of any size, shape, and thickness effective to accomplish its purpose. Furthermore, the at least one protrusion 107 may be spring loaded as described above.

In some embodiments, the at least one protrusion 107 may provide for a removable connection with a receptacle body allowing the receptacle repair insert 100 to be removed from the receptacle body after insertion. The removability may be functionalized by a release mechanism disposed upon the at least one protrusion 107. The release mechanism may be a button, latch, handle, or any other device effective to allow the at least one protrusion 107 to detach from the receptacle body.

Figure 1D:
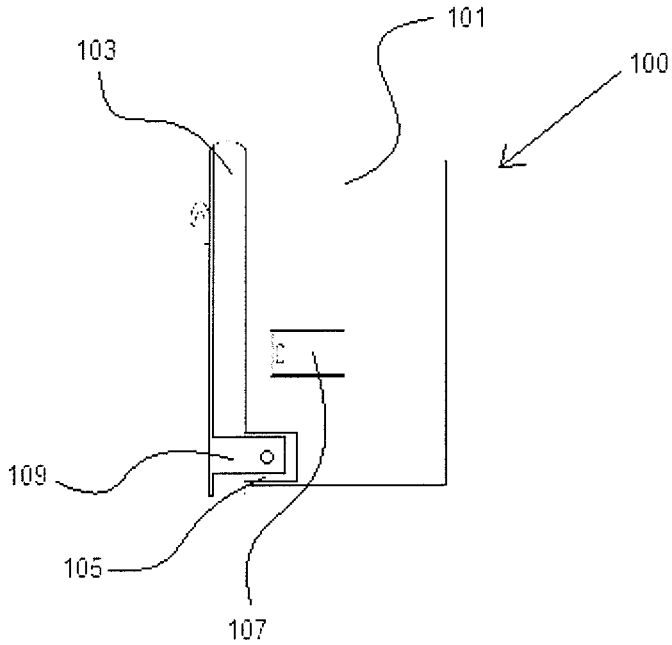
FIG. 1D is a side view of an embodiment of a receptacle repair insert in accordance with the present Disclosure.

In at least some embodiments, at least one extension 109 may be movably connected to the insert body 101 and effective to create a door. FIGS. 1B and 1C do not show this feature, and FIG. 1D shows the feature in a closed position. The door may be effective to block at least a portion of the at least one orifice, thereby allowing or cutting off access to the orifice and contents therein. The extension 109 may be a mailbox door.

In at least some embodiments, the extension 109 is attached with a hinge connection. At least one hinge 105 may be present on the receptacle repair insert 100. The at least one hinge 105 may be disposed on the flange 103, or any other part of the insert body 101. The at least one hinge 105 may be integrally formed from or on the insert body 101 or flange 103. The at least one hinge 105 may provide a rotatable connection for the extension 109.

For example, the at least one hinge 105 may be at least one flap formed from said flange 103 or said insert body 101 as shown in FIG. 1D. The at least one flap may be welded to said flange 103 or said insert body 101 alternatively. The at least one flap may be bent such that it is parallel with said insert body 101. A fastener such as a bolt, screw, or the like may be put through the flap such that extension 109 may connect and rotate on the fastener.

The at least one hinge 105 may have at least one spring effective to pull said extension to block said at least one portion of said orifice. In some embodiments, the at least one spring is a torsional spring or a linear spring.

A receptacle repair insert 100 or any portion thereof may be made from at least one material selected from the group comprising at least one metal, at least one alloy, at least one non-metal, at least one non-metal composition, or any combination thereof.

As a non-limiting example, the at least one metal and at least one metal alloy may have at least one metal selected from the group consisting of aluminum, iron, nickel, copper, or any combination thereof. As a non-limiting example, the at least one non-metal may comprise at least one ceramic, plastic, polymer, non-metal composition, and combinations thereof.

Further disclosed is a method for replacing at least receptacle one door, having the steps of providing at least one receptacle repair insert 100 as described above, removing at least one undesired receptacle door if one exists, and placing the at least one receptacle repair insert 100 into the at least one receptacle.

The receptacle may be a mailbox, and thus the receptacle repair insert may be called a mailbox repair insert.

The method may further have the step of securing the at least one mailbox repair insert to said at least one mailbox using an attachment method as described above.

The receptacle repair insert and methods associated therewith may be used in replacing broken or otherwise undesirable mailbox doors amongst other things. For example, the receptacle repair insert may be useful when a mailbox is encased in a structure, such as a brick wall, and is not easily accessed without destroying the structure. Instead of having to tear down a structure surrounding a mailbox simply to replace a mailbox door, the receptacle repair insert may be used to fix an undesired mailbox door.

Figure 2:
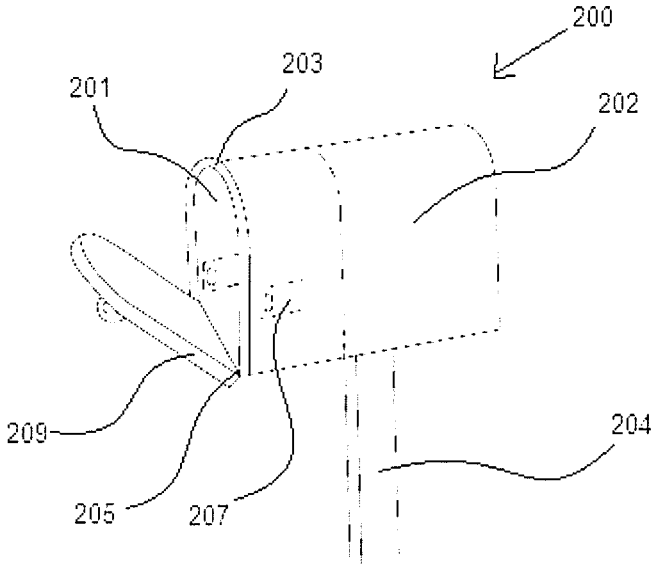
FIG. 2 is a perspective view of a mailbox comprising an embodiment of a receptacle repair insert in accordance with the present Disclosure.

FIG. 2 shows an embodiment of a receptacle repair insert in accordance with the present Disclosure fitted inside a mailbox. In FIG. 2, insert body 201 is placed in mailbox 202. Connected to the insert body 201 are a flange 203, at least one hinge 205, two protrusions 207 and an extension 209, all as described above. In FIG. 2, flange 203 abuts the front edge of the mailbox 202 and protrusions 207 hold the insert body in place. The extension 209 is rotatably connected to hinge 205 and capable of opening and closing access to the mailbox 202. Mailbox 202 is on a post 204 and may be surrounded by at least one wall or structure.

While various disclosed embodiments have been described above, it should be understood that they have been presented by way of example only, and not limitation. Numerous changes to the subject matter disclosed herein can be made in accordance with this Disclosure without departing from the spirit or scope of this Disclosure. In addition, while a particular feature may have been disclosed with respect to only one of several implementations, such feature may be combined with one or more other features of the other implementations as may be desired and advantageous for any given or particular application.

Thus, the breadth and scope of the subject matter provided in this Disclosure should not be limited by any of the above explicitly described embodiments. Rather, the scope of this Disclosure should be defined in accordance with the following claims and their equivalents.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

What is claimed is:

1. A receptacle repair insert apparatus, comprising:

an insert body having an outer surface comprising a first shape and effective to attach to a receptacle body having an inner surface comprising a second shape, said inner surface defining at least one orifice, said insert body effective to fit into said at least one orifice;

at least one flange provided on an outer surface of the insert body at an end of the insert body, to abut a terminus of the receptacle body when the insert body is inserted into the receptacle body;

at least one extension movably connected to said end of said insert body and effective to create a door, said door blocking at least a portion of said at least one orifice; and at least one spring-loaded protrusion disposed at said end of said insert body, wherein said at least one spring-loaded protrusion is effective to communicate with at least one contour of said inner surface such that said insert body is attached to said receptacle body.

2. The apparatus of claim 1, wherein said receptacle body is a mailbox.

3. The apparatus of claim 1, wherein said first shape is approximately the same as said second shape such that said insert body is effective to fit into said at least one orifice in a manner that said outer surface abuts and follows said inner surface.

4. The apparatus of claim 1, wherein said extension is attached with a hinge connection.

5. The apparatus of claim 4, wherein said hinge connection comprises a spring effective to pull said extension to block said portion of said orifice.

6. A method of replacing at least one mailbox door; comprising:

providing at least one mailbox repair insert comprising an insert body having an outer surface with a bottom, said outer surface having a shape effective to fit an inner surface of at least one mailbox, at least one attachment structure on the outer surface of the insert body, said attachment structure effective to removably secure said outer surface to said inner surface, and at least one mailbox door rotatably connected to said insert body and effective to open and close access to said at least one mailbox, wherein, at a front end of the insert body, at least one flange circumscribes the insert body, except at the bottom, to abut a terminus of the mailbox when the insert body is inserted into the mailbox;

removing at least one undesired mailbox door if one exists; and placing said at least one mailbox repair insert into said at least one mailbox, until the at least one attachment structure is removably connected to the inner surface of the mailbox and until the flange abuts the terminus of the mailbox to guide the placement of the insert body within the mailbox.

7. The method of claim 6, wherein said mailbox repair insert is made from at least one material selected from the group consisting of at least one metal, at least one alloy, at least one non-metal, or at least one non-metal composition.

8. The method of claim 7 wherein said at least one metal and at least one metal alloy comprise a metal selected from the group consisting of aluminum, iron, nickel, or copper.

9. The method of claim 7 wherein said at least one non-metal composition comprises plastic, ceramic, and combinations thereof.

10. A method of replacing at least one mailbox door, comprising:

providing at least one mailbox repair insert comprising an insert body having an outer surface, said outer surface having a shape effective to fit an inner surface of at least one mailbox, and at least one mailbox door rotatably connected to said insert body and effective to open and close access to said at least one mailbox, wherein at least one flange is provided on an outer surface of the insert body at an end of the insert body;

removing at least one undesired mailbox door if one exists; and placing said at least one mailbox repair insert into said at least one mailbox, until the flange abuts a portion of the mailbox to guide the placement of the insert body within the mailbox;

securing the at least one mailbox repair insert to said at least one mailbox using an attachment method, wherein said attachment method is a shrink fit process.

* * * * *